US008480374B2

(12) United States Patent
Yang

(10) Patent No.: US 8,480,374 B2
(45) Date of Patent: Jul. 9, 2013

(54) METHOD AND AUTO-CONTROL SYSTEM ON IMPROVING PUMPING SYSTEM PERFORMANCE

(76) Inventor: Zhijin Yang, Hong Kong (CN)

( * ) Notice: Subject to any disclaimer, the term of this patent is extended or adjusted under 35 U.S.C. 154(b) by 659 days.

(21) Appl. No.: 12/748,448

(22) Filed: Mar. 28, 2010

(65) Prior Publication Data

US 2010/0254827 A1 Oct. 7, 2010

(30) Foreign Application Priority Data

Apr. 3, 2009 (CN) ..... 2009 1 0131127

(51) Int. Cl.
*F04B 49/06* (2006.01)

(52) U.S. Cl.
USPC ..... 417/44.1; 417/18; 417/20; 417/36; 417/43; 417/53; 700/282; 702/55

(58) Field of Classification Search
USPC ..... 417/44.1, 18, 20, 36, 43, 53; 702/45–50, 702/55; 700/281, 282
See application file for complete search history.

(56) References Cited

U.S. PATENT DOCUMENTS 5,904,126 A * 5/1999 McKay et al. ..... 123/196 S
6,178,393 B1 * 1/2001 Irvin ..... 703/10
6,325,093 B1 * 12/2001 Ooshima ..... 137/392
7,845,913 B2 * 12/2010 Stiles et al. ..... 417/44.11
7,901,190 B2 * 3/2011 Gray ..... 417/22
2001/0041139 A1 * 11/2001 Sabini et al. ..... 417/18
2007/0154319 A1 * 7/2007 Stiles et al. ..... 417/42
2007/0154322 A1 * 7/2007 Stiles et al. ..... 417/44.1
2007/0154323 A1 * 7/2007 Stiles et al. ..... 417/44.1
2007/0166169 A1 * 7/2007 Venkatachari et al. ..... 417/36
2008/0229819 A1 * 9/2008 Mayleben et al. ..... 73/304 C

* cited by examiner

*Primary Examiner* — Charles Freay
*Assistant Examiner* — Ryan Gatzemeyer
(74) *Attorney, Agent, or Firm* — Eagle IP Limited; Jacqueline C. Lui

(57) ABSTRACT

The present invention discloses a method and auto-control system on improving pumping system performance. The system contains a pump, a pool, pipelines, a parameter setting module, a water level measuring module and a system control module. The parameter setting module is configured to preset a characteristic parameter and a control parameter of the pump and the pipelines. The water level measuring module is configured to measure, determine and compute a high level pool water level, a flow demand trend and a system instantaneous flow at regular intervals. The system control module is configured to receive the data sent by the water level measuring module that is measured and computed, and controls the operation of the system based on the data. Compared to existing pumping control system, the system in the present invention can save energy for 10%-30%.

8 Claims, 5 Drawing Sheets

METHOD AND AUTO-CONTROL SYSTEM ON IMPROVING PUMPING SYSTEM PERFORMANCE

CROSS-REFERENCE TO RELATED APPLICATION

This application claims benefit under 35 U.S.C. §119(a) of Chinese Patent Application having Serial No. 200910131127.6 filed Apr. 3, 2009, which is hereby incorporated by reference herein in its entirety.

FIELD OF INVENTION

This invention relates to a method and auto-control system utilized by pumps for industrial, commercial and civil use, and in particular a method and auto-control system on improving pumping system performance.

BACKGROUND OF INVENTION

Existing control systems utilized by pumps for industrial, commercial and civil use mainly uses two control methods: 1) operating at power frequency without speed adjustment of the pump motor; and 2) operating at variable frequency, using a frequency converter to adjust the rotation speed of the pump. However, the deficiency of these two methods is non-energy-saving or the energy-saving characteristic is not obvious. The particular reasons thereof are that 1) for a pump operating at power frequency, it is not possible for the operation parameters of the pump to match completely with the requirements of the pipeline system; and 2) for a pump operating at variable frequency, the operation parameters of the pump can only partially match with the requirements of the pipeline system, and cannot always control the pump to run in a high energy efficiency zone.

SUMMARY OF INVENTION

In order to overcome the above-mentioned deficiency in existing control systems utilized by pumps for industrial, commercial and civil use, the present invention provides a method and auto-control system on improving pumping system performance, which is suitable for any kind of pumps and make pumping systems operating with high efficiency by PLC control. The method and auto-control system on improving pumping system performance in the present invention includes a control system, control software and a pumping system. The control system determines the flow demand trend in the pipeline system by detecting the flow demand signal and operation status signal of the pump in the pipeline system and logically analyzing. The PLC automatically provides an operation frequency based on a preset best energy efficiency zone, and realizes the high efficiency and energy-saving operation control of the pumping system. The auto-control system on improving pumping system performance in the present invention comprises a plurality of pumps. The number of pumps can be at most 10 or more, and is appropriately 2-3 in general.

To address the above-mentioned technical problems, the present invention provides an auto-control system on improving pumping system performance comprising a pump, a pool, pipelines, a parameter setting module, a water level measuring module and a system control module.

The parameter setting module is configured to preset a characteristic parameter and a control parameter of the pump and the pipelines.

The water level measuring module is configured to measure, determine and compute a high level pool water level, a flow demand trend and a system instantaneous flow at regular intervals. The water level measuring module further sends data obtained from the measuring, determining and computing to the system control module.

The system control module is configured to receive the data sent by the water level measuring module that is measured and computed, and controls the operation of the system based on the data.

when the data received by the system control module is $L_L<L<L_H$, the auto-control system is in energy-saving operation mode, and preferably carries out the following operations:

a) when A↓ and $Q_L<B<Q_H$, then Q=B;

b) when A↓ and $B\leqq Q_L$, then $Q=Q_L$;

c) when A↓ and $B\geqq Q_H$, then $Q=Q_H$;

d) when A↑ and $Q_L<B<Q_H$, then Q=1.05B;

e) when A↑ and $B\leqq Q_L$, then $Q=Q_L$;

f) when A↑ and $B\geqq Q_H$, then $Q=Q_H$;

wherein L is an actual operating water level, $L_L$ is a water level lower limit, $L_H$ is a water level upper limit, Q is an actual operating flow of said pump, $Q_H$ is a pump flow upper limit, $Q_L$ is a pump flow lower limit, A is the flow demand trend, and B is the instantaneous flow.

When the data received by the system control module is $L\leqq L_L$, the auto-control system preferably carries out the following operation:

a) when $B\leqq Q_0$, then $Q=Q_0$ and when the water level reaches $L_M$, the auto-control system turning to the energy-saving operation mode as described in Claim 2;

b) when $B>Q_0$, then a main pump is running at power frequency; a backup pump is activated; the main pump and the backup pump is operating in parallel until the water level reaches $L_M$; when the water level reaches $L_M$, the backup pump is stopped and the auto-control system turns to the energy-saving operation mode as described in Claim 2;

wherein $L_M$ is an average water level and $Q_0$ is a pump flow at power frequency.

When the data received by the system control module is $L\leqq L_H$, the auto-control system preferably carries out the following operations:

the main pump turns to a sleeping mode; when the water level reaches $L_M$, a system control module wakes up the main pump;

wherein $L_M$ is an average water level.

The system control module is preferably implemented by PLC. An input module of the PLC receives a flow demand signal, an operation parameter of a frequency converter and a pump switch and a stop signal from the pumping system. An output module of the PLC sends an operation frequency signal to the frequency converter, and sends a timely operation parameter and a fault protection parameter to a touch screen. The frequency converter controls the rotation speed of a pump motor according to the operation frequency signal from the PLC and outputs a real-time operation parameter signal to the PLC. The touch screen displays the real-time operation parameter, a preset parameter and system protection and fault information, and sends data to a host computer. An inductive measuring loop feedbacks the flow demand signal of the pipelines to the PLC.

To address the above-mentioned technical problems, the present invention further provides an auto-control method on improving pumping system which includes the following steps:

a) presetting a characteristic parameter and a control parameter of a pump and pipelines;

b) measuring, determining and computing a high level pool water level, a flow demand trend and a system instantaneous flow at regular intervals; and c) controlling the operation of the pumping system based on the high level pool water level, the flow demand trend and the system instantaneous flow obtained from the measuring, determining and computing.

When a data obtained from the measuring, determining and computing step is $L_L<L<L_H$, an auto-control system is in energy-saving operation mode, and preferably carries out the following operations:

a) when A↓ and $Q_L<B<Q_H$, then Q=B;

b) when A↓ and $B\leqq Q_L$, then $Q=Q_L$;

c) when A↓ and $B\geqq Q_H$, then $Q=Q_H$;

d) when A↑ and $Q_L<B<Q_H$, then Q=1.05B;

e) when A↑ and $B\leqq Q_L$, then $Q=Q_L$;

f) when A↑ and $B\geqq Q_H$, then $Q=Q_H$, wherein L is an actual operating water level, $L_L$ is a water level lower limit, $L_H$ is a water level upper limit, Q is an actual operating flow of said pump, $Q_H$ is an pump flow upper limit, $Q_L$ is a pump flow lower limit, A is the flow demand trend, and B is the instantaneous flow.

When the data obtained from the measuring, determining and computing step is $L\leqq L_L$, the auto-control system preferably carries out the following operations:

g) when $B\leqq Q_0$, then $Q=Q_0$ and when the water level reaches $L_M$, the auto-control system turns to the energy-saving operation mode as described in Claim 7;

h) when $B>Q_0$, then a main pump being runs at power frequency; a backup pump is activated; the main pump and the backup pump is operating in parallel until said water level reaches $L_M$; when the water level reaches $L_M$, the backup pump is stopped and the auto-control system turns to the energy-saving operation mode as described in Claim 7.

wherein $L_M$ is an average water level and $Q_0$ is an pump flow at power frequency.

When the data obtained from the measuring, determining and computing step is $L\geqq L_H$, the auto-control system preferably carries out the following operations:

the main pump turns to a sleeping mode; when the water level reaches $L_M$, a system control module wakes up the main pump;

wherein $L_M$ is an average water level.

The above-mentioned method may be implemented by PLC. An input module of the PLC receives a flow demand signal, a operation parameter of an frequency converter and a pump switch and stop signal from the pumping system. An output module of the PLC sends an operation frequency signal to the frequency converter and a timely operation parameter and a fault protection parameter to a touch screen. The frequency converter controls the rotation speed of a pump motor according to the operation frequency signal from the PLC and outputs a real-time operation parameter signal to the PLC. The touch screen displays the real-time operation parameter, a preset parameter and system protection and fault information, and sends data to a host computer. An inductive measuring loop feedbacks the flow demand signal of the pipelines to the PLC.

The method and auto-control system on improving pumping system performance in the present invention is able to automatically measure and predict the flow demand of the pipeline system, and controls the pumping system to operating in high efficiency zone in most of the time. Compared to existing pumping control system, the system in the present invention can save energy for 10%-30%.

Figure 1:
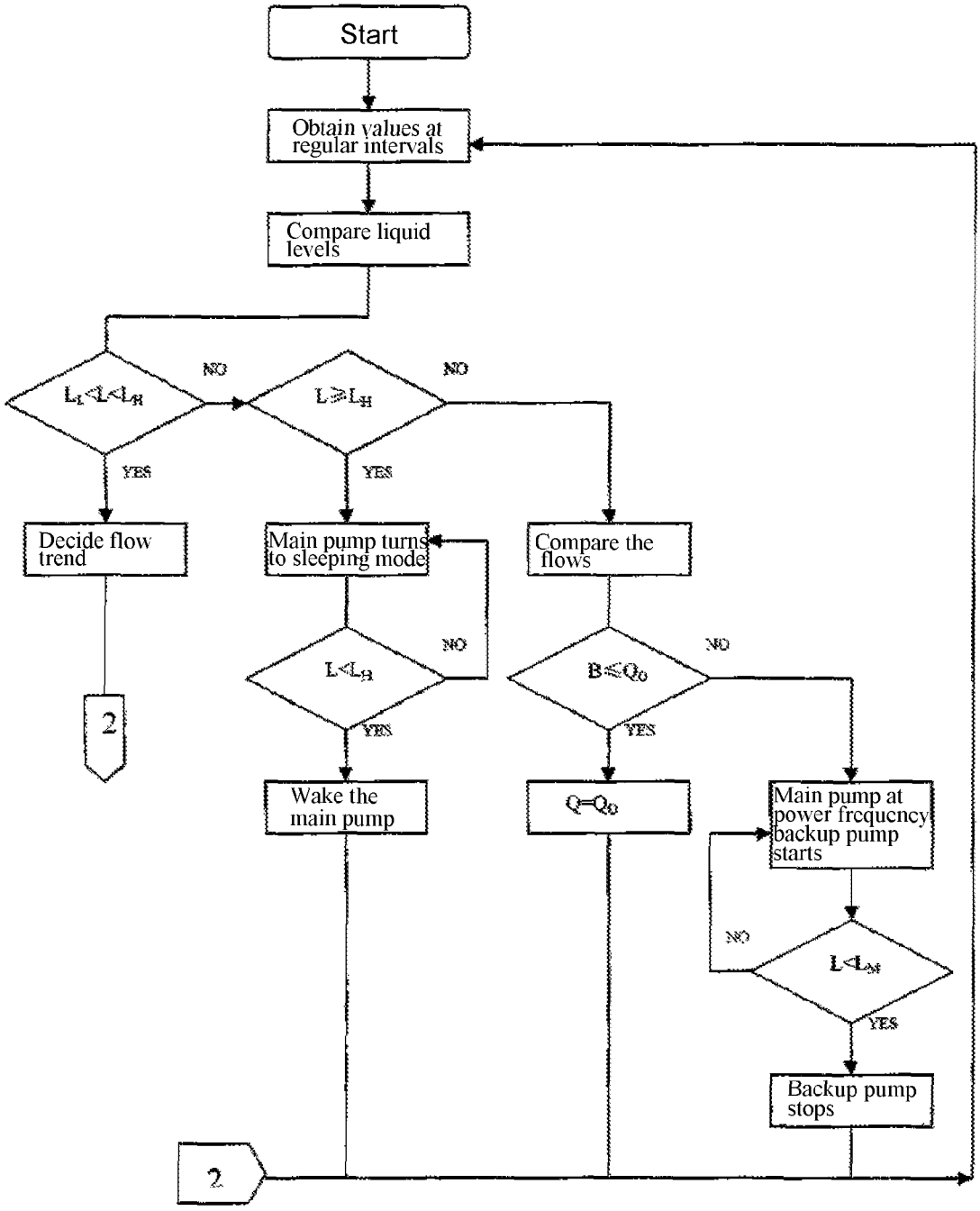
FIG. 1 is a system flowchart according to one embodiment of the present invention.

In the drawing, the respective reference characters are as follows:

Controller 301, frequency converter 302, liquid level transmitter 303, flow transmitter 304, main pump 401, backup pump 402, low level pool 501, high level pool 502, user 503.

DETAILED DESCRIPTION OF THE PREFERRED EMBODIMENTS

In order to overcome the above-mentioned deficiency in existing control systems utilized by pumps for industrial, commercial and civil use, the present invention provides a method and auto-control system on improving pumping system performance, which is suitable for any kind of pumps and make pumping systems operating with high efficiency by PLC control. The method and auto-control system on improving pumping system performance in the present invention includes a control system, control software, a pumping system and a pipeline system. The control system determines the flow demand trend in the pipeline system by detecting the flow demand signal and operation status signal of the pump in the pipeline system and logically analyzing. The PLC automatically provides an operation frequency based on a preset best energy efficiency zone, and realizes the high efficiency and energy-saving operation control of the pumping system. The auto-control system on improving pumping system performance in the present invention comprises a plurality of pumps. The number of pumps can be at most 10 or more, and is appropriately 2-3 in general.

The present invention provides a method and auto-control system on improving pumping system performance, which is suitable for any kind of pumps and make pumping systems operating with high efficiency by PLC control.

The PLC as herein referred to is the Programmable logic Controller, which is a new industrial control device based on computer technologies. In the PLC standard draft promulgated by the International Electrical Committee (IEC) in 1987 gave a definition to the PLC: The PLC with its full name of Programmable Logic Controller, is defined as a electronic system of digital computing operation which is designed specifically for applying in an industrial environment. The PLC uses one kind of programmable storage device to store programs internally and execute user-oriented commands such as logical computation, sequential control, timing, counting and arithmetic operation, as well as controlling various types of machines or production processes by digital or analog input/output. PLC is a programmable logic circuit, and also a language that ties heavily to the hardware. It has very important applications in semiconductors, and one can say that wherever there is a semiconductor, there is PLC.

PLC is an electronic device of digital computing operation which is designed especially for applying in an industrial environment. The PLC uses a programmable storage device to store programs internally and execute user-oriented commands such as logical computation, sequential control, timing, counting and arithmetic operation, as well as controlling various types of machines or production processes by digital or analog input/output. PLC and its relevant peripheral devices should all be designed according to the principle of easily forming an integrated part of industrial control systems and easily expanding its functions.

The method and auto-control system on improving pumping system performance in the present invention includes a control system, control software and a pumping system. The control system determines the flow demand trend in the pipeline system by detecting the flow demand signal and operation status signal of the pump in the pipeline system and logically analyzing. The PLC automatically provides an operation frequency based on the best energy efficiency zone that is preset, and realizes the high efficiency and energy-saving operation control of the pumping system. The auto-control system on improving pumping system performance in the present invention comprises a plurality of pumps. The number of pumps can be at most 10 or more, and is appropriately 2-3 in general.

Figure 5:
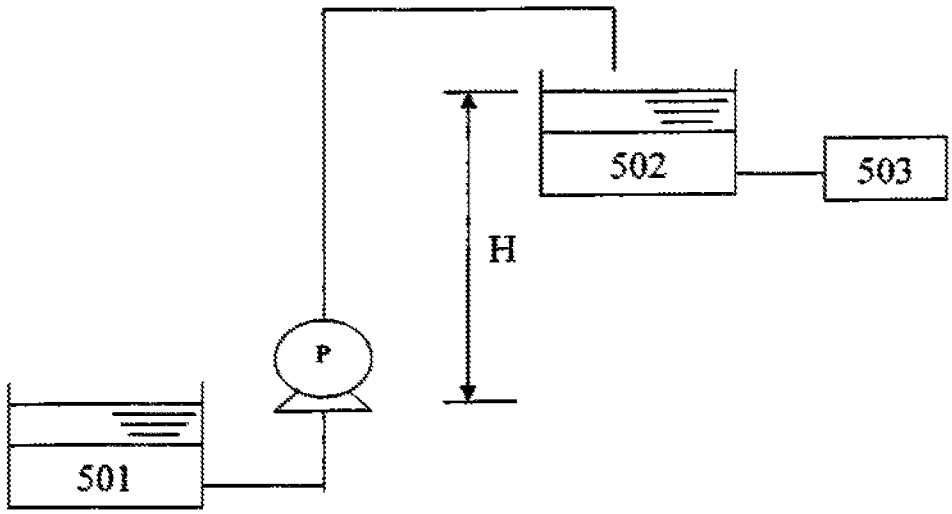
FIG. 5 is a schematic diagram of the pumping system and pipeline system according to one embodiment of the present invention.

FIG. 5 is a schematic diagram of a pumping and pipeline system which comprises two pumps according to one embodiment of the present invention. The number of pumps is 2-3. By monitoring the water level of the high level pool, the system controls the operating flow of the pumps. The pumps deliver the water to the high level pool 502 via the pipeline system, and the high level pool 502 distributes the water to user 503 via the pipelines.

Figure 2:
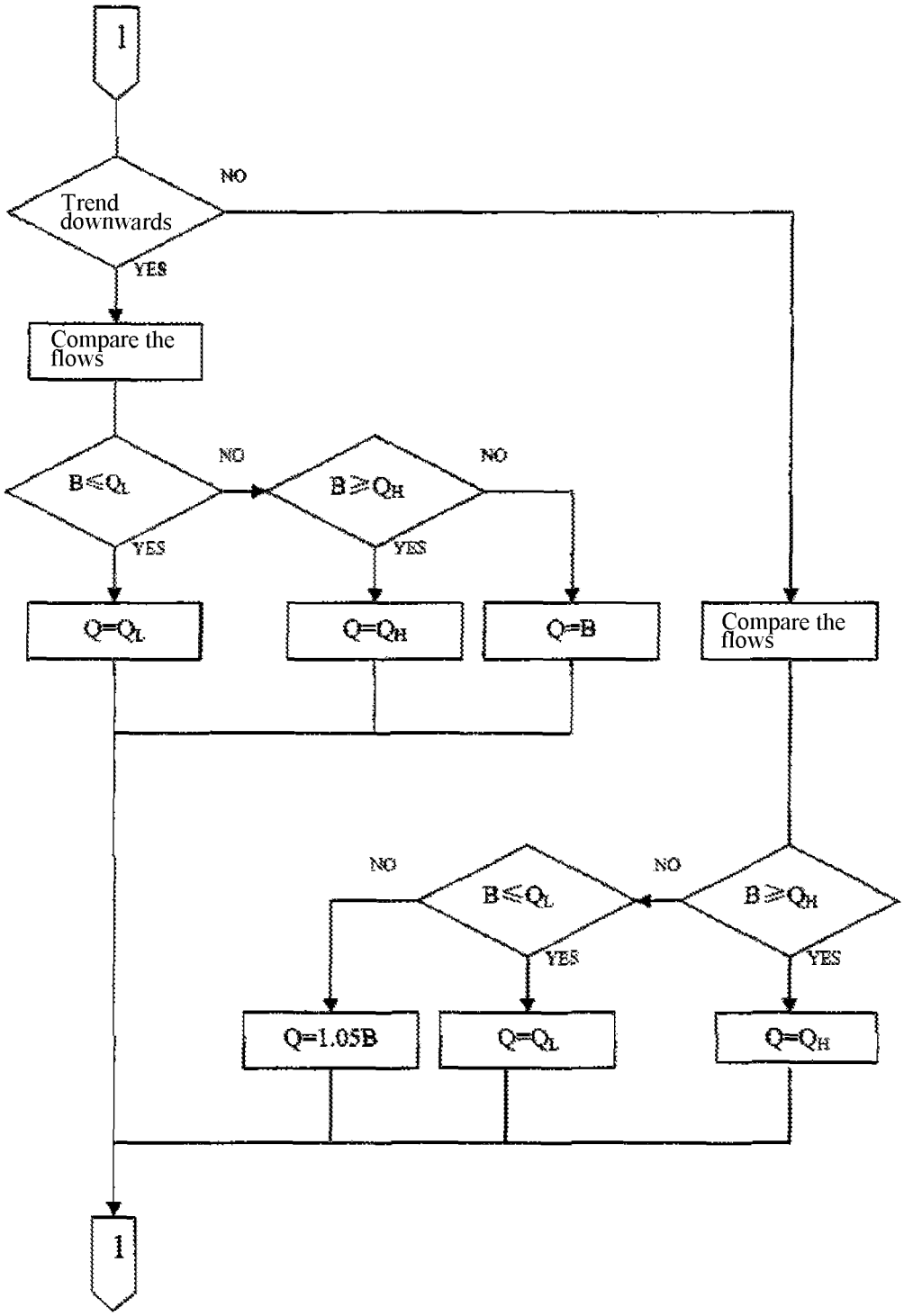
FIG. 2 is a system flowchart according to another embodiment of the present invention.

FIG. 1 and FIG. 2 show the control system flow chart according to one embodiment of the present invention. The working principles of the method and auto-control system on improving pumping system performance in the present invention is as follows:

Definition of Parameters:

1. Water Level:

Actual operating water level: L

Water level lower limit: $L_L$

Average water level: $L_M$

Water level upper limit: $L_H$

2. Pump flow:

Actual operating flow: Q

Flow upper limit: $Q_H$

Flow lower limit: $Q_L$

Flow at power frequency: $Q_0$

3. Flow demand trend: A

4. Instantaneous flow: B

The control system presets a characteristic parameter and a control parameter of the pump and the pipeline system. The water level measuring system measures, determines and computes the high level pool water level L, the flow demand trend A and the system instantaneous flow B at regular intervals, which serves as a basis to control the operation of the system.

The logic control process is:

1. if $L_L<L<L_H$, the auto-control system is in energy-saving operation mode, a) when A↓ and $Q_L<B<Q_H$, then Q=B;

b) when A↓ and $B\leqq Q_L$, then $Q=Q_L$;

c) when A↓ and $B\geqq Q_H$, then $Q=Q_H$;

d) when A↓ and $Q_L<B<Q_H$, then Q=1.05B;

e) when A↑ and $B\leqq Q_L$, then $Q=Q_L$;

f) when A↑ and $B\geqq Q_H$, then $Q=Q_H$;

2. if $L\leqq L_L$, a) when $B\leqq Q_0$, then $Q=Q_0$ and when the water level reaches $L_M$, the auto-control system turning to the energy-saving operation mode;

b) when $B>Q_0$, then a main pump is running at power frequency; a backup pump is activated; the main pump and the backup pump is operating in parallel until the water level reaches $L_M$; when the water level reaches $L_M$, the backup pump is stopped and the auto-control system turns to the energy-saving operation mode;

3. if $L\geqq L_H$, the main pump turns to a sleeping mode; when the water level reaches $L_M$, a system control module wakes up the main pump.

Meanwhile, the present invention realizes the swapping of the main pump and the backup pump by monitoring the operation time of the main pump, so that the operation time of the main pump and that of the backup pump can distributed evenly.

Figure 3:
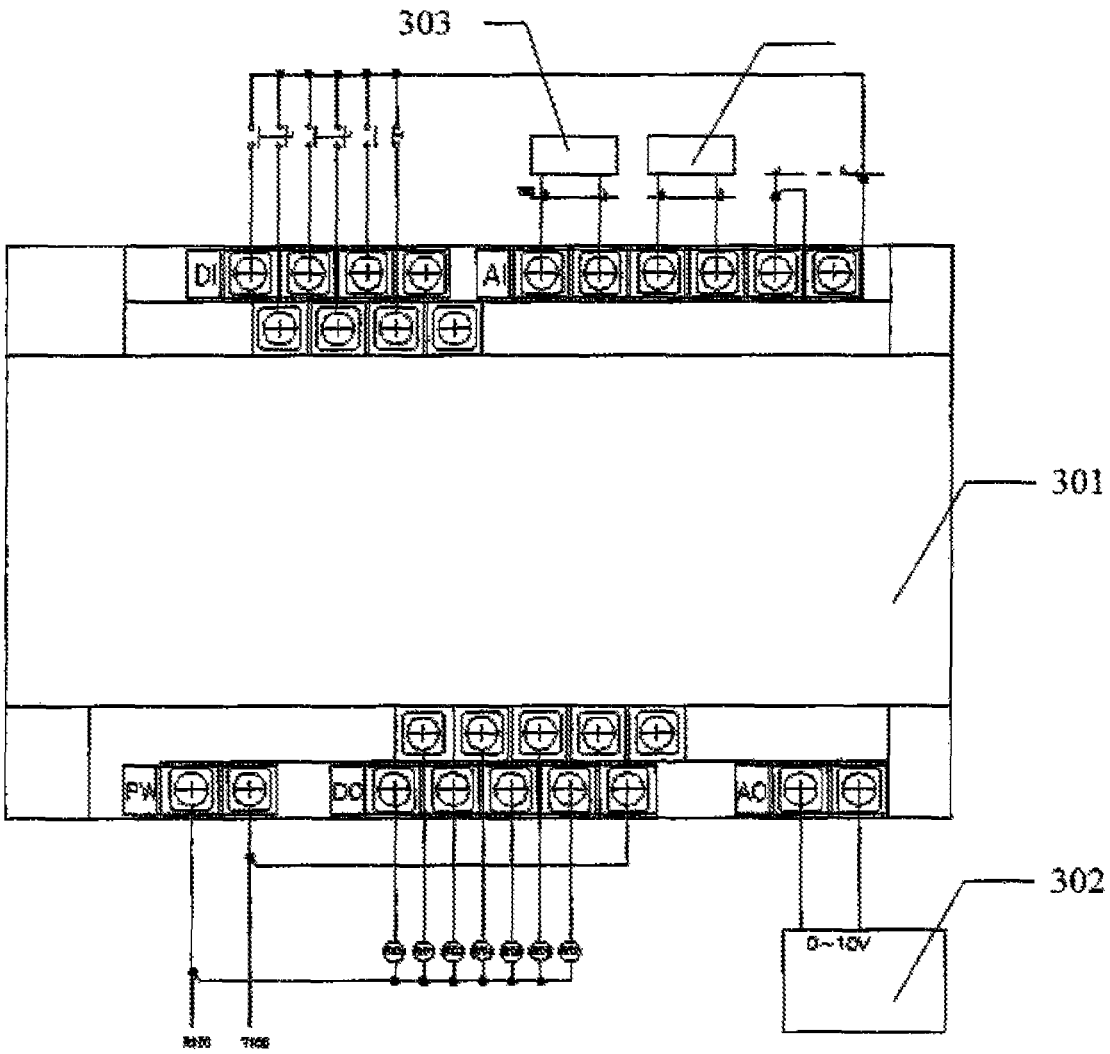
FIG. 3 is a wiring diagram of the PLC controller according to one embodiment of the present invention.
Figure 4:
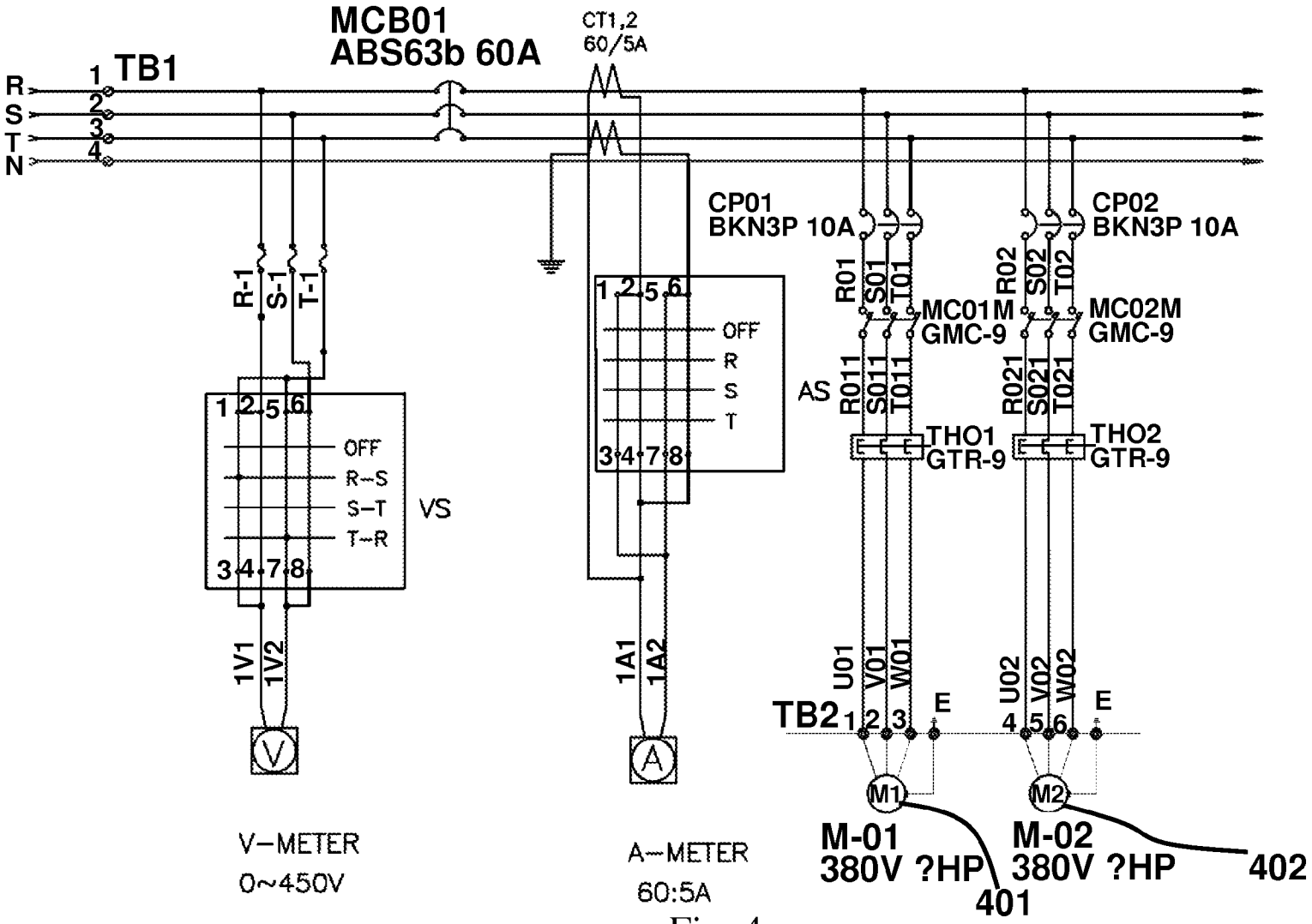
FIG. 4 is a main loop diagram of the pumping station control system comprising two pumps according to one embodiment of the present invention.

FIG. 3 and FIG. 4 show the PLC controller wiring diagram and the main loop 260 diagram of the pumping station control system comprising two pumps respectively, according to embodiments of the present invention. In the drawings, the respective reference characters are as follows: Controller 301, frequency converter 302, liquid level transmitter 303 and flow transmitter 304. The method and auto-control system on improving pumping system performance in the present invention includes a control system, control software, and a pumping system. The pumping system includes a plurality of pumps, of which the models can be identical or different. The number of pumps is 1 to 10, or even more. The PLC has the control software installed therein. An input module of the PLC receives a flow demand signal, an operation parameter of a frequency converter and a pump switch and stop signal from the pumping system. An output module of the PLC 270 sends an operation frequency signal to the frequency converter and a timely operation parameter and a fault protection parameter to a touch screen. The frequency converter controls the rotation speed of the pump motor according to the operation frequency signal from the PLC and outputs a real-time operation parameter signal to the PLC. The touch screen displays the real-time operation parameter, a preset parameter and system 275 protection and fault information, and sends data to a host computer. An inductive measuring loop feedbacks the flow demand signal of the pipelines to the PLC.

The switching signal between manual operation and automatic operation was given by the manual/auto switch on the control cabinet. When the switch points to "manual", the system can only operate at the manual fixed frequency. When the switch points to "automatic", the system automatically operates according to a set program. The emergency stop signal is given by the emergency stop button on the control cabinet. When the system is in automatic mode, the control collects the digital and analog signals required. Firstly, the system designates the main pump and the backup pump according to the signal of the variable frequency ready selection switch. This switch should not be changed during the operation of the system. Then, the controller stores the analog signals of the collected liquid level and flow transmitter (4-20 mA) at regular times, and make a decision of the comparison of liquid levels and the flow change trend according to a logic control request (as shown in FIG. 1 and FIG. 2). The decision is then used for determining the instantaneous flow value and the actions of the power frequency, the variable frequency or the pumps. The instantaneous flow value is generated by the controller via a digital to analog conversion module (0-10V) output control frequency converter. The actions of the power frequency and the variable frequency are generated by the controller digital output control contactor KM01M, KM02M. The actions of the main pump and the backup pump are generated by KM03M to KM06M.

The number of pumps in this embodiment can be 3.

The number of pumps in this embodiment can also be 1-2.

The measuring parameter of the measuring loop in this embodiment can be the pipeline pressure from the pump outlet to the pipeline outlet.

The measuring parameter of the measuring loop in this embodiment can also be the flow in the pump or in the pipeline.

The measuring parameter of the measuring loop in this embodiment can also be the technological requirement to the flow.

The measuring parameter of the measuring loop in this embodiment can also be the flow velocity of the water in the pipeline.

The method and auto-control system on improving pumping system performance in the present invention is able to automatically measure and predict the flow demand of the pipeline system, and controls the pumping system to operating in high efficiency zone in most of the time. Comparing to existing pumping control system, the system in the present invention can save energy for 10%-30%.

What is claimed is:

1. An auto-control system on improving pumping system performance comprising a pump, a pool, pipelines, a parameter setting module, a water level measuring module and a system control module, characterized in that:

a) said parameter setting module configured to preset a characteristic parameter and a control parameter of said pump and said pipelines;

b) said water level measuring module configured to measure, determine and compute a high level pool water level, a flow demand trend and a system instantaneous flow at regular intervals; said water level measuring module further sending data obtained from said measuring, determining and computing to said system control module; and c) said system control module configured to receive said data sent by said water level measuring module that is measured and computed, and controlling the operation of said system based on said data;

wherein said system control module is implemented by a PLC; an input module of said PLC receiving a flow demand signal, an operation parameter of a frequency converter and a pump switch and stop signal from said pumping system; an output module of said PLC sending an operation frequency signal to said frequency converter and a timely operation parameter and a fault protection parameter to a touch screen; said frequency converter controlling the rotation speed of a pump motor according to said operation frequency signal from said PLC and outputting a real-time operation parameter signal to said PLC; said touch screen displaying said real-time operation parameter, a preset parameter and system protection and fault information, and sending data to a host computer; an inductive measuring loop feedbacking said flow demand signal of said pipelines to said PLC.

2. The auto-control system of claim 1, characterized in that when said data received by said system control module is LL<L<LH, said auto-control system is in energy-saving operation mode, and carries out the following operations:

a) when A↓ and QL<B<QH, then Q=B;

b) when A↓ and B≦QL, then Q=QL;

c) when A↓ and B≧QH, then Q=QH;

d) when A↑ and QL<B<QH, then Q=1.05B;

e) when A↑ and B≦QL, then Q=QL;

f) when A↑ and B≧QH, then Q=QH;

wherein L being an actual operating water level, LL being a water level lower limit, LH being a water level upper limit, Q being an actual operating flow of said pump, QH being a pump flow upper limit, QL being a pump flow lower limit, A being said flow demand trend, and B being said system instantaneous flow.

3. The auto-control system of claim 2, characterized in that when said data received by said system control module is L≦LL, said auto-control system carries out the following operations:

a) when B≦Q0, then Q=Q0 and when said water level reaches LM, said auto-control system turning to said energy-saving operation mode as described in claim 2;

b) when B>Q0, then a main pump running at power frequency; a backup pump being activated; said main pump and said backup pump operating in parallel until said water level reaches LM; when said water level reaches LM, said backup pump being stopped and said auto-control system turning to said energy-saving operation mode as described in claim 2;

wherein LM being an average water level and Q0 being a pump flow at power frequency.

4. The auto-control system of claim 2, characterized in that when said data received by said system control module is L≧LH, said auto-control system carries out the following operations:

said main pump turning to a sleeping mode; when said water level reaches LM, said system control module waking up said main pump;

wherein LM being an average water level.

5. An auto-control method for improving pumping system performance characterized in that said method comprising the following steps:

a) presetting a characteristic parameter and a control parameter of a pump and pipelines;

b) measuring, determining and computing a high level pool water level, a flow demand trend and a system instantaneous flow at regular intervals; and c) controlling the operation of said pumping system based on said high level pool water level, said flow demand trend and said system instantaneous flow obtained from said measuring, determining and computing;

wherein said method is implemented by a PLC; an input module of said PLC receiving a flow demand signal, an operation parameter of a frequency converter and a pump switch and stop signal from said pumping system; an output module of said PLC sending an operation frequency signal to said frequency converter and a timely operation parameter and a fault protection parameter to a touch screen; said frequency converter controlling the rotation speed of a pump motor according to said operation frequency signal from said PLC and outputting a real-time operation parameter signal to said PLC; said touch screen displaying said real-time operation parameter, a preset parameter and system protection and fault information, and sending data to a host computer; an inductive measuring loop feedbacking said flow demand signal of said pipelines to said PLC.

6. The auto-control method of claim 5, characterized in that when said data obtained from said measuring, determining and computing step is LL<L<LH, an auto-control system is in energy-saving operation mode, and carries out the following operations:

a) when A↓ and QL<B<QH, then Q=B;

b) when A↓ and B≦QL, then Q=QL;

c) when A↓ and B≧QH, then Q=QH;

d) when A↑ and QL<B<QH, then Q=1.05B;

e) when A↑ and B≦QL, then Q=QL;

f) when A↑ and B≧QH, then Q=QH;

wherein L being an actual operating water level, LL being a water level lower limit, LH being a water level upper limit, Q being an actual operating flow of said pump, QH being a pump flow upper limit, QL being a pump flow lower limit, A being said flow demand trend, and B being said system instantaneous flow.

7. The auto-control method of claim 6, characterized in that when said data obtained from said measuring, determining and computing step is L≦LL, said auto-control system carries out the following operations:

a) when B≦Q0, then Q=Q0 and when said water level reaches LM, said auto-control system turning to said energy-saving operation mode as described in claim 6;

b) when B>Q0, then a main pump running at power frequency; a backup pump being activated; said main pump and said backup pump operating in parallel until said water level reaches LM; when said water level reaches LM, said backup pump being stopped and said auto-control system turning to said energy-saving operation mode as described in claim 6;

wherein LM being an average water level and Q0 being a pump flow at power frequency.

8. The auto-control method of claim 6, characterized in that when said data obtained from said measuring, determining and computing step is L≧LH, said auto-control system carries out the following operations:

said main pump turning to a sleeping mode; when said water level reaches LM, a system control module of said auto-control system waking up said main pump;

wherein LM being an average water level.

* * * * *